United States Patent [19]

Switall

[11] 4,064,801

[45] Dec. 27, 1977

[54] SPRAY DAMPENING SYSTEM FOR OFFSET PRINTING

[75] Inventor: Thomas G. Switall, Chicago, Ill.

[73] Assignee: Ryco Graphic Manufacturing, Inc., Chicago, Ill.

[21] Appl. No.: 722,623

[22] Filed: Sept. 13, 1976

Related U.S. Application Data

[63] Continuation-in-part of Ser. No. 604,016, Aug. 12, 1975, abandoned.

[51] Int. Cl.[2] ..... B41F 7/24; B41L 25/06

[52] U.S. Cl. ..... 101/147; 101/366

[58] Field of Search ..... 101/147, 148, 366; 239/127; 118/7

[56] References Cited

U.S. PATENT DOCUMENTS

| | | | |
|---|---|---|---|
| 2,347,619 | 4/1944 | Taylor | 101/350 |
| 2,408,449 | 10/1946 | Russell | 101/147 |
| 2,448,226 | 8/1948 | Marsden | 101/147 |
| 3,134,325 | 5/1964 | Worthington | 101/365 |
| 3,301,699 | 1/1967 | Mozzi | 118/259 |
| 3,308,754 | 3/1967 | Munn | 101/348 |
| 3,385,522 | 5/1968 | Kock | 118/9 X |
| 3,651,756 | 3/1972 | Smith, Jr. | 101/147 |
| 3,749,313 | 7/1973 | Weitmann | 239/127 |
| 3,835,774 | 9/1974 | Heidt | 101/148 |
| 3,871,615 | 3/1975 | Donner | 251/129 |
| 3,937,175 | 2/1976 | Horner | 118/7 |

FOREIGN PATENT DOCUMENTS

| | | | |
|---|---|---|---|
| 2,203,046 | 8/1973 | Germany | 101/148 |
| 1,611,313 | 8/1971 | Germany | 101/147 |
| 2,022,114 | 12/1971 | Germany | 101/147 |
| 434,107 | 5/1934 | United Kingdom | 101/365 |

*Primary Examiner*—J. Reed Fisher
*Attorney, Agent, or Firm*—Lee & Smith

[57] ABSTRACT

The disclosed system controls through novel pressure and valving adjustment mechanisms the application of dampening fluid to the ink roll or offset plate on the plate cylinder of an offset printing press. In one embodiment the dampening fluid at a relatively high pressure passes through a pressure compensator which adjusts the fluid pressure in response to changes in the speed of the press. The fluid at the adjusted pressure is then directed to the spray bar of the system, where it is discharged through a plurality of spray nozzles controlled by a plurality of solenoid-actuated valves. In one embodiment, the valves continually fluctuate between open and closed positions, with the time of the fluctuations being adjustable in order to selectively and accurately meter the amount of dampening fuid applied to the offset plate on the plate cylinder of the press. In a second embodiment, the valves are adjustable and continuously open during spraying, and in a third embodiment the degree of opening of the valves is regulated in response to changes in the press speed and the pressure may be maintained at a manually adjustable level.

16 Claims, 13 Drawing Figures

18
66
20'
20"
22"
26"
32"
28"
44"
42"
54"
22'
28'
26'
24'
32'
30
40
44'
42'
54'
68
50
52
52
38

210
L
M
144
152
148
150
166
160
174
212
164
50
G
H
146
O
M
54
B
170
C
D
E
F
60
172
158
162
156
154
168

190
190
190
24 V
204
V
U
T
S
R
Q
196
196
196
202
213
+
215
144
146
208
RECTIFYING CIRCUITRY
A B C D E F G H I J K L M N O
68
60
170
64
206
210
216
218
50

SPRAY DAMPENING SYSTEM FOR OFFSET PRINTING

This application is a continuation in part of application Ser. No. 604,016, now abandoned, filed Aug. 12, 1975.

THE BACKGROUND OF THE INVENTION

This invention relates to an improved system for spray dampening the plate cylinder of an offset printing press, and more particularly to a system for more accurately controlling the amount of dampening fluid delivered to the plate cylinder for improvement of print quality.

In the offset printing process, a small amount of a dampening solution, i.e., water with certain additives, is supplied to the offset plate, which then comes in contact with the inking rollers, the ink adhering to the image on the plate and the dampening solution adhering to the other portions of the plate. The quantity and placement of the dampening solution must be varied for different types and densities of ink, variations in printing densities and ink coverages, and press speed. Control of the application of the dampening fluid is particularly important in four-color process, where variations will affect color. If too little fluid is applied, printing will occur in areas where none is desired. If too much fluid is applied, printing may not occur in some areas, and scumming may also occur.

Various systems for dampening the plate cylinder of an offset printing apparatus are in use today. One such system employs dampening rollers which rotate partially within an open trough containing dampening fluid. The dampening rollers bear directly or indirectly against the plate cylinder, thereby supplying a film of dampening fluid to the plate cylinder. This system, however, suffers from a number of inherent disadvantages from the standpoint of both operation and maintenance. From the operational standpoint, the system is too imprecise and difficult to control. Frequently, too much or too little solution is applied to the plate roller, or at least to certain areas of the plate roller, reducing the printing quality. Moreover, since the system is open to the atmosphere, contaminants from paper lint or other foreign material enter the system, algae tends to form in the fluid container, the pH is constantly changing due to evaporation and contamination, and substantial foaming of the fluid tends to occur. In order to reduce these problems to manageable levels, elaborate recirculation systems are commonly employed, and all such systems require constant attention by the press operator. In addition to these problems of control, there is a normal lag time between starting of the printing press and sufficient dampening of the plate cylinder to begin the printing operation. Moreover, there is no means of varying the application of dampening solution to certain areas of the plate cylinder. From the standpoint of maintenance, the cleaning of the dampening system rollers, troughs and other parts is one of the most disagreeable of press room chores.

Another type dampening system which has been employed more recently is the Smith spray system described in U.S. Pat. No. 3,651,756 and No. 3,764,070. This type system eliminates the open fluid container and the immersed dampening roll, and replaces them with a closed system which pumps dampening fluid as a spray onto a dampening roll train for application to the plate cylinder. However, because of the employment of pumps, air is drawn into this system, and therefore the system is prone to the formation of small air bubbles which interfere with the pumping action and causes imprecise application of the dampening fluid. In addition, priming of the system for start-up operation is frequently required. In order to minimize these problems, the system incorporates special priming and air purging apparatus as well as a recirculation circuit which is cumbersome and must be maintained.

SUMMARY OF THE INVENTION

The present invention overcomes the above-delineated problems with the prior art by providing a fully automatic system, sealed to the atmosphere, which meters the dampening fluid to the plate cylinder in precise amounts positively and accurately controlled without fluid pumps and without the necessity of a fluid recirculation system. The system is self-cleaning, eliminates contaminants and foaming, and reduces algae.

In accordance with one embodiment of the invention, the spray dampening system for delivering the dampening fluid to the rotating cylinders of the printing press comprises a plurality of spray nozzles, means for supplying dampening fluid under pressure to the spray nozzles, means supplying air under pressure to the spray nozzles to atomize and transport the fluid to the printing press cylinder, valve means intermediate the supply means and the nozzles for controlling the flow of fluid to each of the nozzles, and an adjustable control means for the valve means for repetitively opening and closing the valve means at an adjustable time cycle rate whereby the amount of fluid supplied to the nozzles may be adjustably metered.

It is preferred also that there be a means for adjusting the delivery of the dampening fluid to the printing press cylinders in accordance with the speed of the press. For this purpose, a pressure compensator means may be provided intermediate the supply means and the valve means, the pressure compensator means being responsive to the speed of the press for adjusting the pressure of the dampening fluid supplied to the valve means, whereby the pressure will be increased as the press speed is increased and the rate of fluid discharged from the nozzles will be increased.

It is preferred that there be a separate valve means for each individual spray nozzle and that there be a separate adjustable control means for each valve means.

In accordance with another embodiment of the invention a manual valve adjustment means is substituted for the adjustable control means and the valve means remain open at all times during the spraying operation. The pressure is adjusted by the pressure compensator means responsive to the speed of the press. This embodiment is advantageous in certain exceptionally high speed applications such as newspaper printing presses where large quantities of dampening fluid are required by the press.

In accordance with still another embodiment of the invention an automatic valve adjustment means is substituted for the adjustable control means and the pressure remains constant or is manually adjusted. The valves remain open at all times during spraying operation and the automatic valve adjustment means adjusts the degree of opening of the valve means in response to the speed of the press.

BRIEF DESCRIPTION OF THE DRAWINGS

One embodiment of the invention is illustrated in the following drawings in which.

DETAILED DESCRIPTION OF THE PREFERRED EMBODIMENTS

Figure 1:
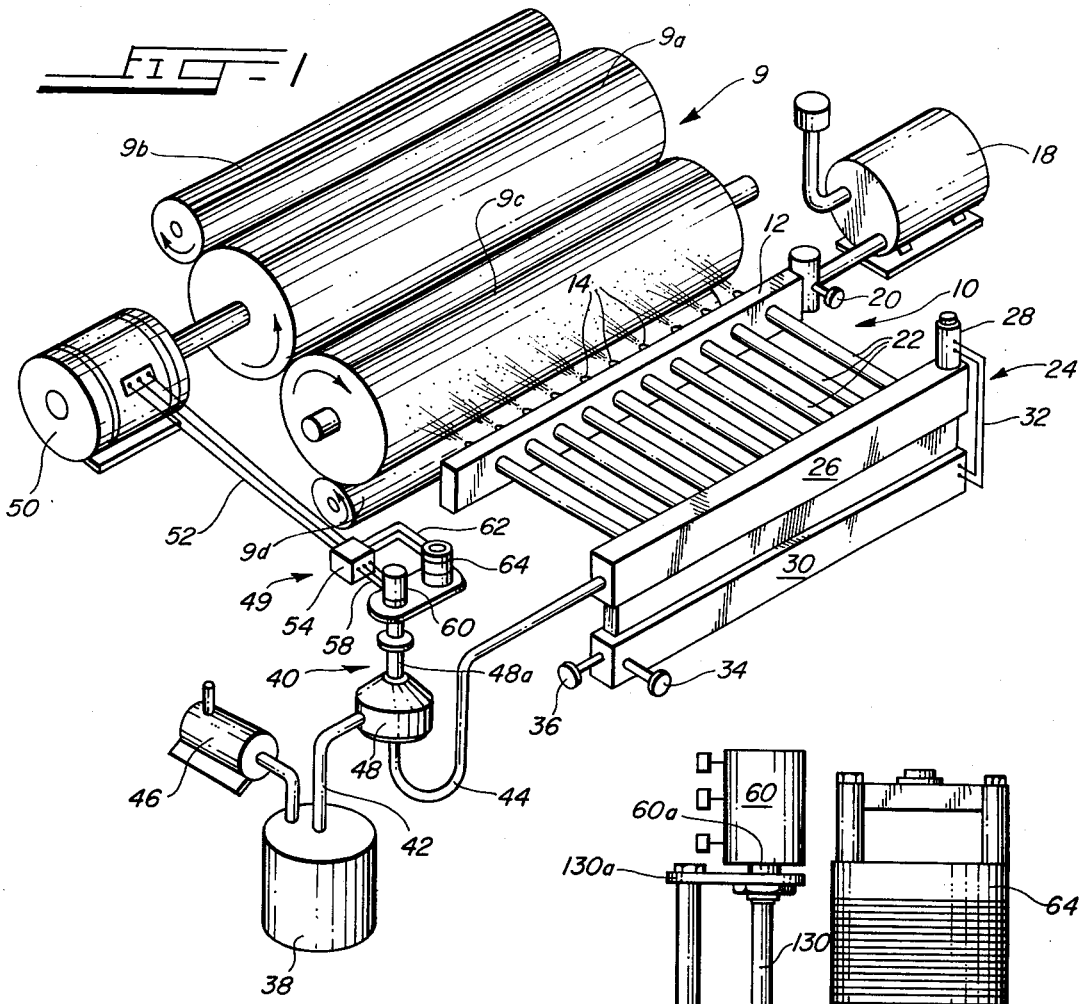
FIG. 1 is a perspective view of portion of a plate cylinder and an inking roll of an offset printing press schematically showing the basic components of a spray dampening system constructed in accordance with the present invention.

In FIG. 1 there is shown portions of a web offset printing press 9, namely, a plate cylinder 9*a*, which carries an offset plate (not shown), and an inking roller 9*b*, which applies printing ink to the image on the offset plate carried by the plate cylinder and a pair of dampening rolls 9*c* and 9*d*, which spread the dampening solution onto the offset plate prior to inking. The apparatus 10 shown in FIG. 1 is adapted to apply a dampening fluid to the dampening roll 9*c* for spreading onto the offset plate on the plate cylinder. In certain applications, the dampening solution may be applied to the inking rolls, thereby eliminating the dampening rolls entirely. The dampening fluid is principally water with surface active additives (usually of a proprietary nature) carried in solution. The composition of the dampening fluid and the pH level thereof should be controlled for optimum printing results, and it is highly desirable to permit accurate variation of the application of dampening fluid where the printing density varies on the piece being printed.

The apparatus 10 has a spray bar 12 which houses a plurality of spray nozzles 14 for directing the dampening fluid to the dampening or inking rolls of a press. Only one plate cylinder and one spray bar 12 are shown, although it will be realized that a spray bar is provided for each plate cylinder 9*a* of the press. Each spray bar 12 is provided with a source of pressurized air from a suitable air supply pump 18, the quantity of air delivered by the spray bar being controlled by a conventional valve 20. The air serves to atomize and transport the dampening fluid from the nozzles 14 to the surface of the dampening roll 9*c*. The dampening fluid is supplied to the manifold 26 from a supply reservoir 38 through a pressure compensator 40 having an intake pressure line 42 and outflow pressure line 44. The fluid in the reservoir 38 may be maintained under a pressure, preferably in the range of about 50 psi, by a suitable air pump 46. No liquid pumps are employed.

The pressure compensator 40 includes an adjustable reducing valve 48, of standard and well-known construction, and a press speed responsive control mechanism 49. The pressure reducing valve 48 has a threaded adjustment member 48*a* rotatable in one direction to increase the pressure and in the other direction to decrease the pressure in the outflow pressure line 44 leading to the manifold 26 and the valves 28. In the preferred embodiment, the adjustable pressure reducing valve 48 adjusts the outflow pressure to within the range of about 2 to 15 psi. The press speed responsive control mechanism 49 senses the speed of the printing press and accordingly adjusts the threaded adjustment member 48*a* of the reducing valve 48.

The dampening fluid is conveyed to each of the spray nozzles 14 of the spray bar 12 through conduits 22 from the fluid quantity control apparatus 24. The fluid quantity control apparatus 24 includes a fluid manifold 26 upon which is mounted a plurality of solenoid-actuated metering valves 28. Although for the sake of simplicity only one metering valve 28 is illustrated, in practice, one metering valve 28 would be associated with each of the spray nozzles 14 of the spray bar 12. Each of the metering valves 28 communicates with a common channel within the fluid manifold 26 and controls the flow of dampening fluid to its associated spray nozzle 14 through the associated individual conduit 22.

The control system 30 for the several solenoid-actuated metering valves 28 may be mounted adjacent the manifold 26 for convenient control of the valves through electrical leads 32, one set of such leads being provided for each valve 28. The control system, as will be more fully described herein, causes the metering valves 28 to repetitively cycle or fluctuate between an open position, where fluid flows therethrough into the conduits 22, and a closed position, where no fluid flows therethrough. The on-off timing cycle for each of the metering valves 28 may be controlled by individual valve adjustment knobs 34 or by means of a single adjustment control knob 36.

The speed responsive control mechanism 49 of the compensator 40 employs a tachometer generator 50 which is operatively connected to the press. In FIG. 1, the tachometer generator is shown connected to the shaft of the plate cylinder 9*a*, but in practice it could be connected to any driven portion of the press in order to sense the speed of the press. The tachometer generator 50 measures the rate of revolution of the plate cylinder 9*a* (i.e. the speed of the press) and provides a voltage indication thereof on wires 52 to a compensator adjustment control circuitry 54. The compensator adjustment control circuitry 54 accepts this first voltage value, indicative of the speed of the press, from the tachometer generator 50 and also accepts a second voltage value indicative of the state of pressure adjustment of the pressure reducing valve 48. This could be through a pressure responsive device such as a transducer in the outflow line 44, but it is most convenient to use a device for sensing the instantaneous position of rotation of the threaded adjustment member 48a of the pressure reducing valve 48. This second voltage may thus be determined by a multiturn potentiometer 60 coupled to the member 48a, with the voltage output presented to the control circuitry 54 by suitable connections, such as leads 58. As will be more fully described herein, these voltages are compared in the compensator adjustment control circuitry 54, and a signal indicative of this comparison is transmitted along the lines 62 to the reversible motor 64. The motor 64, in response to the signal along the lines 62, rotates the pressure regulator shaft 48a in a direction to control the pressure of the fluid in the outflow pressure line 44.

Figure 2:
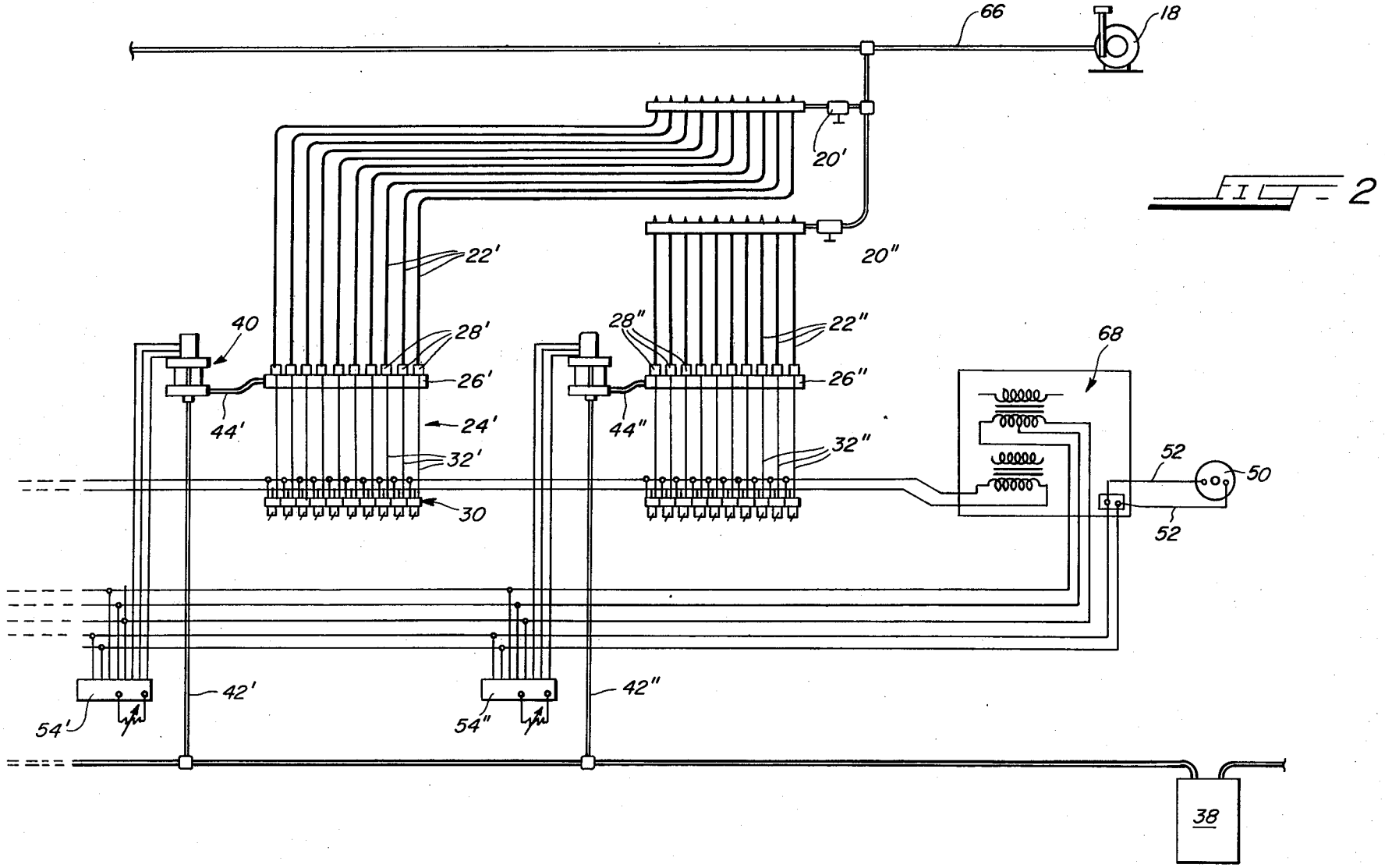
FIG. 2 is a schematic representation of the fluid and electrical circuits of the spray dampening system showing the adaptability of the system to incorporate more than one spraying apparatus.

FIG. 2 schematically depicts two spray dampening systems for applying dampening fluid to the plate cylinders (not illustrated) of an offset printing press. Such plate cylinders may, for example, be those for printing the top and bottom surfaces of the paper or for printing in two colors. In fact, any number of systems may be connected in parallel to the fluid air and electrical supply lines. The air supply pump 18 directs a quantity of air through a supply line 66 to each of two spray bars 12' and 12" through respective valves 20' and 20". The fluid control apparatuses 24' and 24" respectively transmit the dampening fluid to the spray bars 12' and 12" through the conduits 22' and 22". The fluid quality control apparatus 24' includes a fluid manifold 26' with timed metering valves 28' mounted therein. The fluid reservoir 38 provides relatively high pressure dampening fluid to each of the pressure compensator means 40' and 40" through the respective intake or supply lines 42' and 42". The pressure compensator means 40' and 40" are in turn controlled by their respective compensator adjustment control circuits 54' and 54", which communicate with the tachometer generator 50 through the wires 52. As described in detail hereafter, a power supply 68 furnishes the necessary power to the circuitry of the control system 30 for timed metering valves 28 and to the compensator adjustment control circuitry 54.

Figure 3:
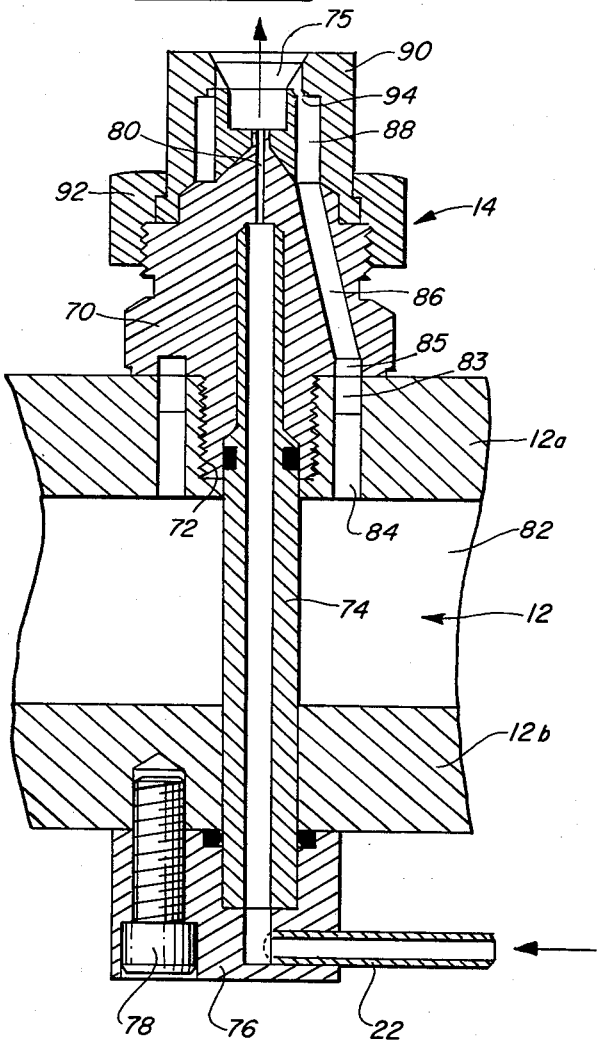
FIG. 3 is an enlarged cross sectional view of a portion of the spray bar showing a single spray nozzle.

In FIG. 3, a portion of the spray bar 12 is depicted in cross section showing the details of one of the spray nozzles 14 which is mounted thereon. Although only one of the spray nozzles 14 is illustrated, it will be appreciated that all are of identical construction. The illustrated nozzle 14 has a threaded mounting member 70 received in a threaded bore 72 extending into the forward wall 12a of the spray bar 12. A fluid tube 74 extends through the rear wall 12b of the spray bar and the forward end of this tube extends into and is sealingly and centrally disposed within the threaded mounting member 70. The opposite end of the tube is sealingly connected to a mounting adapter 76 which is affixed to the spray bar 12 by suitable means, such as a cap screw 78. The adapter 76 connects the tube 74 to the associated conduit 22 from the manifold. A narrow bore 80 extends from the forward end of the fluid tube 74 through the forward end of the threaded mounting member 70 and communicates with a mixing well 75 at the forward extremity of the nozzle.

The central chamber 82 of the spray bar 12 serves as an air manifold chamber for all of the spray nozzles. Surrounding the threaded bore 72 in the forward wall 12a of the spray bar is an annular groove 83, and a plurality of air passages 84 extend through the forward wall 12a into communication with the groove 83. The mounting member 70 has an annular groove 85 corresponding to the groove 83 in the spray bar forward wall, and a passageway 86 extends forwardly therefrom through the threaded mounting member 70 to a cylindrical passageway 88 formed within a spray nozzle cap 90, which is attached to the threaded mounting member 70 by a retaining nut 92. A plurality of ports 94 spaced about the periphery of the mixing well 75 are also formed in the cap 90 and communicate with the cylindrical passageway 88.

The dampening fluid controlled by the associated valve 28 enters the nozzle through the conduit 22, the adapter 76 and the tube 74. The fluid is forced through the narrow bore 80 to the mixing well where it is permitted to expand. Air under a pressure of about 5 psi is conveyed from the central manifold chamber 82 within the spray bar through the passages 84, the annular grooves 83 and 85, the passageways 86 and 88 and the ports 94 to atomize the liquid within the mixing recess 75 and transport it to the press cylinders.

Figure 4:
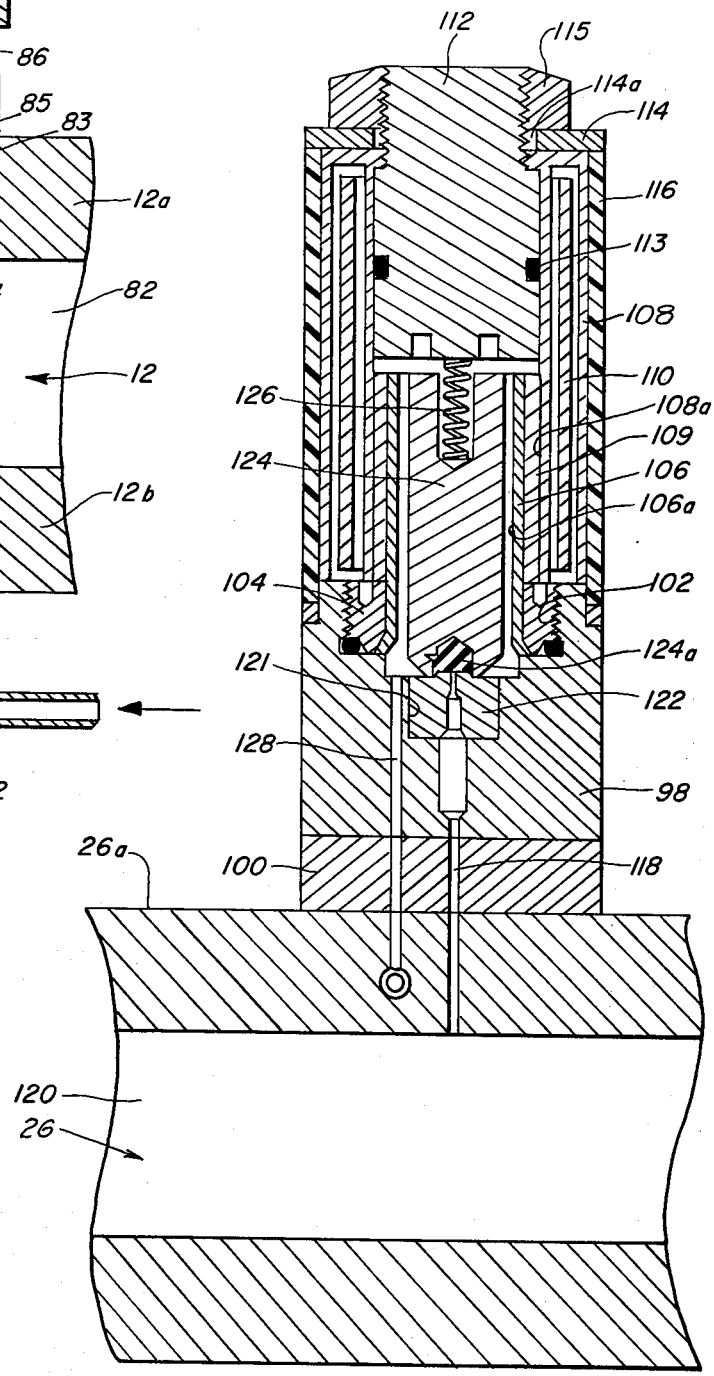
FIG. 4 is a cross sectional view of a single valve for providing metered quantity of dampening fluid to the spray nozzle of FIG. 3.

In FIG. 4, there is illustrated a portion of the fluid manifold 12 showing the cross section of one of the solenoid-actuated metering valves 28 mounted thereon, the valve depicted being representative of the several identical solenoid valves mounted on the manifold. A valve base 98 is attached to a mounting block 100 which in turn is affixed to the top wall 26a of the fluid manifold 26. The upper portion of the valve base 98 has an internally threaded bore 102 into which is received a retaining nut 104 carrying a non-magnetic valve sleeve 106. A solenoid housing 108 having a bore 108a carries a housing sleeve 109 in its forward or lower end which is sealingly attached to the valve sleeve 106. Within the solenoid housing is a solenoid coil 110 and a force adjustment plug 112 is disposed within the rearward or upper end of the housing with an O-ring 113 providing a peripheral seal. The plug 112 extends through an aperture 114a in the rearward wall 114 of the solenoid housing 108 and is capped by a locking nut 115 which also retains the valve housing 116 and provides an adjustment for the plug 112.

A fluid inlet passage 118 extends from the central channel 120 within the fluid manifold 26 through the top wall 26a of the manifold and through the mounting block 100 and valve base 98 into a recess 121 in the base within which is mounted a valve seat 122. A plunger 124 having a resilient seal 124a disposed within the bore 106a of the valve sleeve 106 is urged downwardly by a spring 126 into a position of sealing engagement between the seal 124a and the valve seat 122, the spring 126 bearing against the force adjustment plug 112. The valve plunger thus normally prevents fluid from flowing through the seat 122 into the bore 106a of the valve sleeve surrounding the plunger 124. However, when the solenoid coil 110 is energized (electrical circuitry not illustrated), which will be described in greater detail hereafter, the plunger 124 is drawn upwardly out of contact with the seat 122 allowing fluid to flow through the fluid passage 118 and exit the timed metering valve 28 through a fluid outlet 128 communicating with one of the conduits 22 leading to the associated spray nozzle 14.

Figure 5:
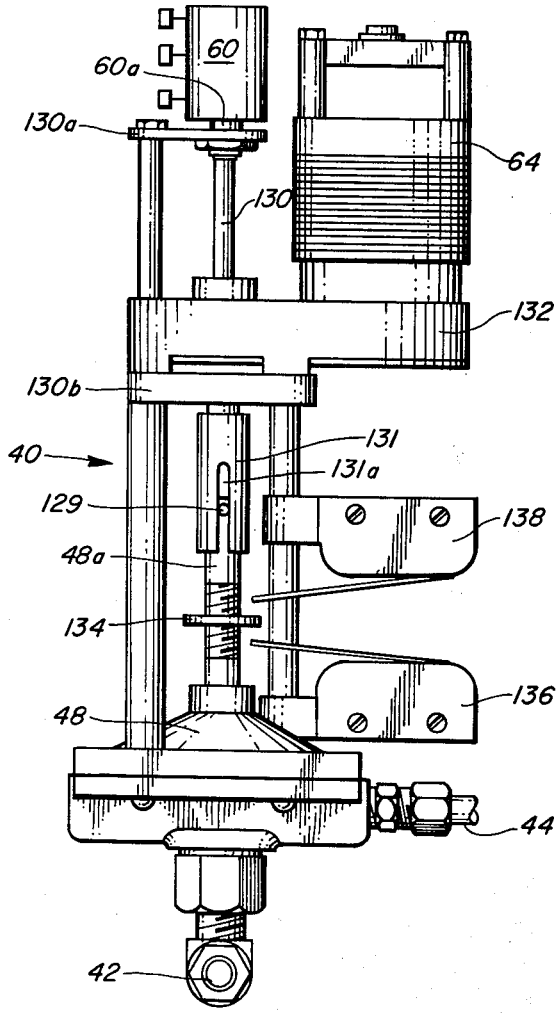
FIG. 5 is an elevational view of the pressure compensator of the present invention.

The pressure compensator 40 is illustrated in detail in FIG. 5, lowers the relatively high pressure of preferably 45 to 50 psi in the supply line 42 to a lower, adjustably variable pressure of preferably 2 to 15 psi in the outflow line 44. The pressure reducing valve 48 of the compensator affects the reduction of pressure, has a threaded adjustment shaft member 48a extending upwardly therefrom. The outflow pressure is increased by rotating the member 48a in one direction and it is decreased by rotating the member in the opposite direction. A pin 129 extends radially outwardly from the upper end of the member 48a, and an axially aligned shaft 130, journalled for rotation in vertically spaced bearing supports 130a and 130b, carries a sleeve connector 131 at its lower end. The connector 131 is adapted to accommodate the upper end of the valve adjustment member 48a and has a slot 131a which is adapted to accommodate the pin 129, thereby providing a lost-motion connection between the shaft 130 and the adjustment member 48a so that only relative axial movement with respect to one another is permitted.

The reversible motor 64 is operatively connected to the shaft 130 by suitable drive connecting means, such as a gear or pully box 132, so that when the motor is operated in one direction it will rotate the valve adjustment member in a direction to advance the member downwardly, and when the motor is operated in the opposite direction it will rotate and advance the member 48a in the opposite direction.

The potentiometer 60 (which is a multiple turn resistance potentiometer) is mounted on the top of the bearing support 130a and has its movable center tap adjustment member 60a affixed to the upper end of the shaft 130. Thus, the movable center tap element 60a of the potentiometer 60 will rotate with the movable valve adjustment member 48a, and a voltage applied across the potentiometer will represent the instantaneous rotational position of adjustment of the valve adjustment member 48a. A switch actuation nut 134 is adjustably affixed to and carried by the adjustment member 48a. A first limit switch 136 and a second limit switch 138 are provided to protect the pressure reducing valve 48 and potentiometer 60 against accidental over-rotation of the adjustment member 48a.

Figure 6A:
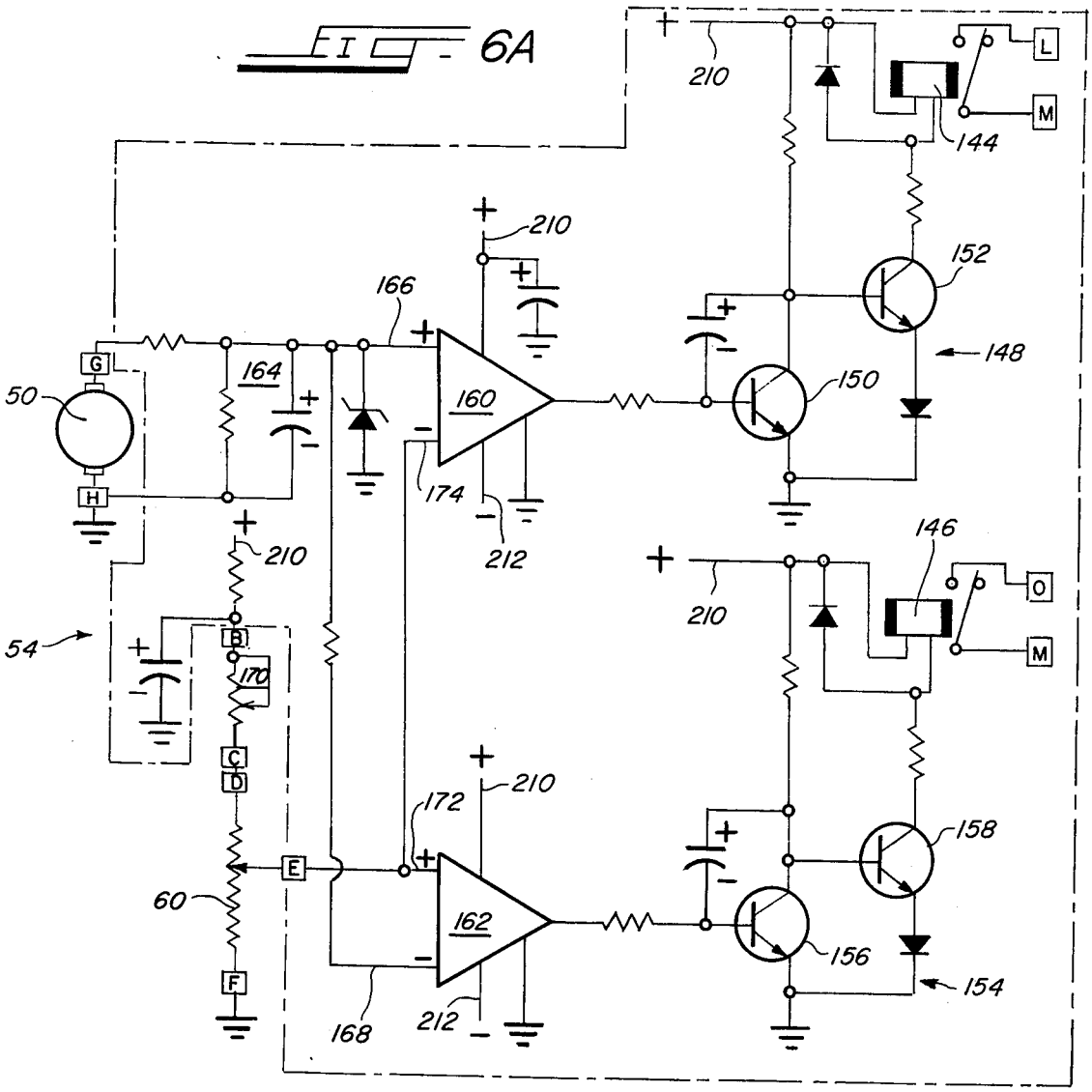
FIGS. 6A and 6B are schematic illustrations of circuitry for controlling the pressure compensator of FIG. 5 and the valve of FIG. 4, respectively.

FIG. 6A depicts one embodiment of the compensator adjustment control circuitry 54 which may be employed by the speed responsive mechanism 49 for controlling the motor 64 and adjusting the compensator 40. The letters A through O indicate only terminal connections for attaching various components of the apparatus to a terminal board containing the compensator adjustment control circuitry 54. A forward relay 144 and a reverse relay 146 are utilized to alternately drive the motor 64 in opposing directions, thereby opening and closing the compensator valve 46. A first Schmidt trigger 148, consisting of a transistor 150 and a transistor 152, energizes the forward relay 144, while a second Schmidt trigger 154, consisting of a transistor 156 and a transistor 158, energizes the reverse relay 146. The output of a first comparator 160 energizes the Schmidt trigger 148, while the output of a second comparator 162 energizes the Schmidt trigger 154. The comparators 160 and 162 are of a conventional integrated circuit design.

As the plate cylinder 16 (FIG. 1) rotates, the tachometer generator 50 will produce a voltage output indicative of the speed of revolution thereof. This voltage indication is applied to the terminals G and H of the compensator adjustment control circuitry 54 and passes through a filter 164 before being applied to the positive terminal 166 of the comparator 160 and the negative terminal 168 of the comparator 162. At the same time, a reference voltage, varied by a potentiometer 170, is applied to the potentiometer 60. The center tap of the potentiometer 60, which is operatively attached to the reducing valve adjustment member 48a, is connected through terminal E of the compensator adjustment control circuitry 54 to the positive terminal 172 of the second comparator 162 and the negative terminal 174 of the first comparator 160.

The voltage indication from the tachometer generator, after being filtered by the filter 164, is applied to the positive terminal 166 of the first comparator 160 and the negative terminal 168 of the comparator 162 as previously described. Additionally, the voltage value indicative of the number of revolutions of the shaft 130 (and member 48a) is received from the center tap of the potentiometer 60 and applied to the positive terminal 172 of the second comparator 162 and the negative terminal 174 of the comparator 160. Since the comparators 161 and 162 are identical, only the operation of the first comparator 160 and its associated circuitry will be described, it being obvious that the operation of the comparator 162 under like conditions will be identical. When the tachometer voltage indication to the positive terminal 166 is greater than the potentiometer voltage value applied to the negative terminal 174, the comparator 160 produces a voltage output which in turn causes the transistor 150 of the Schmidt trigger 148 to cease to conduct. The transistor 152 will then conduct, causing the forward relay 144 to latch and drive the motor 64 in a forward direction, rotating the shaft 130 and member 48a, and opening the pressure reducing valve 48, thereby increasing the pressure in the outflow line 44. At the same time, the center tap of the potentiometer 60 will be rotated with the shaft 130 and member 48a as the latter are rotated to increase the voltage value applied to the negative terminal 174. When the voltages to the positive terminal 166 and the negative terminal 174 are balanced, the comparator 160 will no longer produce an output, and therefore the transistor 150 will turn on, turning off the transistor 152 and unlatching the relay 144, causing the motor 64 to cease revolution.

If the voltage value from the potentiometer 60 were greater than the voltage indication from the tachometer generator 50, the comparator 162 would be energized and the reverse mode of the motor 64 would be initiated. In this manner, increases or decreases in the rate of revolution of the plate cylinder 16 are translated directly into increases or decreases in the pressure supplied through the outflow line 44 to the fluid quantity control apparatus 24. In order to prevent a constant searching for balance between the comparators 160 and 162, they are provided with a built-in hysteresis or dead band.

Figure 6B:
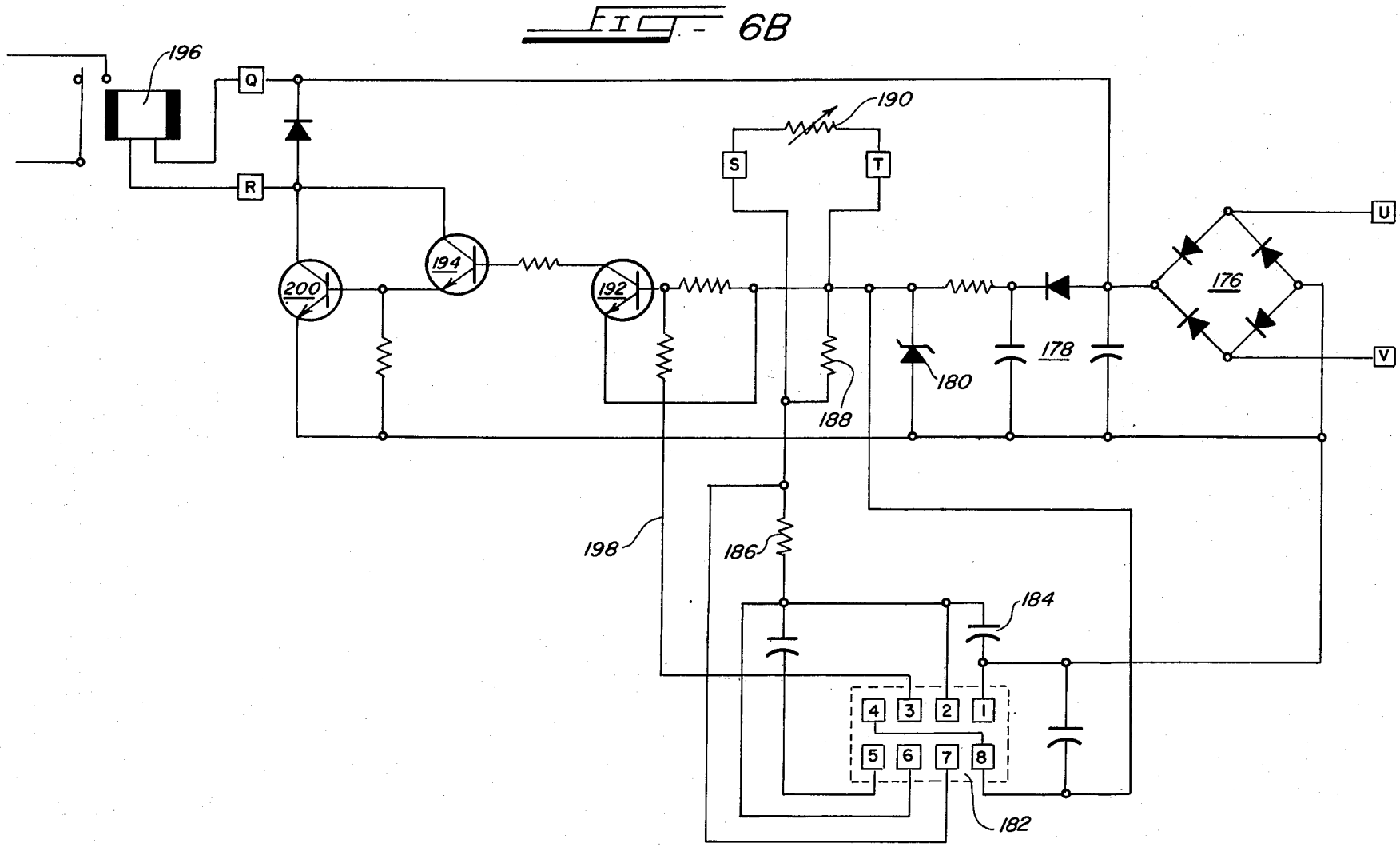

FIG. 6B illustrates one embodiment of the circuitry which can be employed to control and variably actuate one of the solenoid-operated timed metering valves 28. Alternative current voltage is applied to terminals U and V and rectified in a full wave rectifier 176. This voltage is then directed through a filter 178, presenting approximately 15 volts across the zener diode 180. A timing device 182 is also presented with the rectified input voltage at its terminal 8 and the output of the timing device is applied along line 198. The time constant of the timing device 182 is precisely controlled by a capacitor 184 placed in parallel with a resistor 186 and a second resistor 188 which itself is in parallel with a variable resistor 190 connected across the terminals S and T. The variable resistor 190 is manually adjusted by the adjusting member 34 (FIG. 1). The timing device 182 can be any suitable astable multi-vibrator with an externally controlled timing period such as the LM 555 dual-in-line package manufactured by the National Semiconductor Corporation.

The voltage across the zener diode 180 is presented to the emitter of a first transistor 192. A second transistor 194, whose base is connected to the collector of the first transistor 192, will then conduct, causing a third transistor 200 to conduct, presenting a voltage across the terminals Q and R, and energizing a relay 196. The relay 196, when energized, presents a voltage to the solenoid coil 110 (FIG. 4) of one of the timed metering valves 28, raising the plunger 124 and causing fluid to flow through one of the conduits 22 (FIGS. 1 and 3) to one of the spray nozzles 14 where it is atomized and transported by air pressure onto the dampening roll 9c.

When the multi-vibrator 182 produces a positive pulse, this pulse will be directed along line 198 to the base of the transistor 192 which then begins to conduct. As the transistor 192 conducts, it draws the transistors 194 and 200 low, causing them to cease conducting. Therefore, no voltage will be presented across the terminals Q and R, and as a consequence the relay 196 will not be energized, the solenoid coil 110 of the particular time metering valve 28 to which the relay 196 is connected will not be energized, and hece no fluid will flow through the associated conduit 22. However, a negative pulse applied to the base of the transistor 192 by the multi-vibrator 182 will cause the transistor 192 to cease conducting, and consequently allow transistors 194 and 200 to again conduct. Thus, the relay 196 will be reenergized. In this manner, the multi-vibrator 182 will alternately cause the transistor 192 to conduct and then cease conducting, deenergizing and then energizing the relay 196. Therefore, the particular time metering valve 28 to which the relay 196 is connected will alternately inhibit the flow of fluid through its respective conduit 22, and then allow the fluid to flow through the conduit 22 in an accurately timed manner. A circuit of the type illustrated in FIG. 6B is associated with each timed metering valve 28. Therefore, precise control of the time fluctuations of each of the metering valves 28 is controllable separately through the variable resistor 190. In the illustrated circuitry, the variable resistor 190 varies the period of the cycle during which a positive pulse is applied to the base of transistor 192 and thus the "off" or closed cycle of the valve 28. It will be apprecited, however, that an alteration in the circuitry could be made so that the "on" or open time of the valve was varied or even to vary both the "on" and "off" portions of the cycle.

The movable contact of the variable resistor 190 may be adjusted by an individual control knob 34 (FIG. 1). Alternatively, or in addition, a manually operable unit control knob 36 can be connected to all of the movable contacts of the several variable resistors 190 of a particular fluid quantity control apparatus 24 in order to control simultaneously all the timed metering valves 28 of the particular control apparatus in tandem. For this purpose, the shaft of the control knob 36 may operatively and frictionally engage the shafts of the several individual knobs permitting simultaneous adjustment while still allowing individual adjustment as well.

Figure 7:
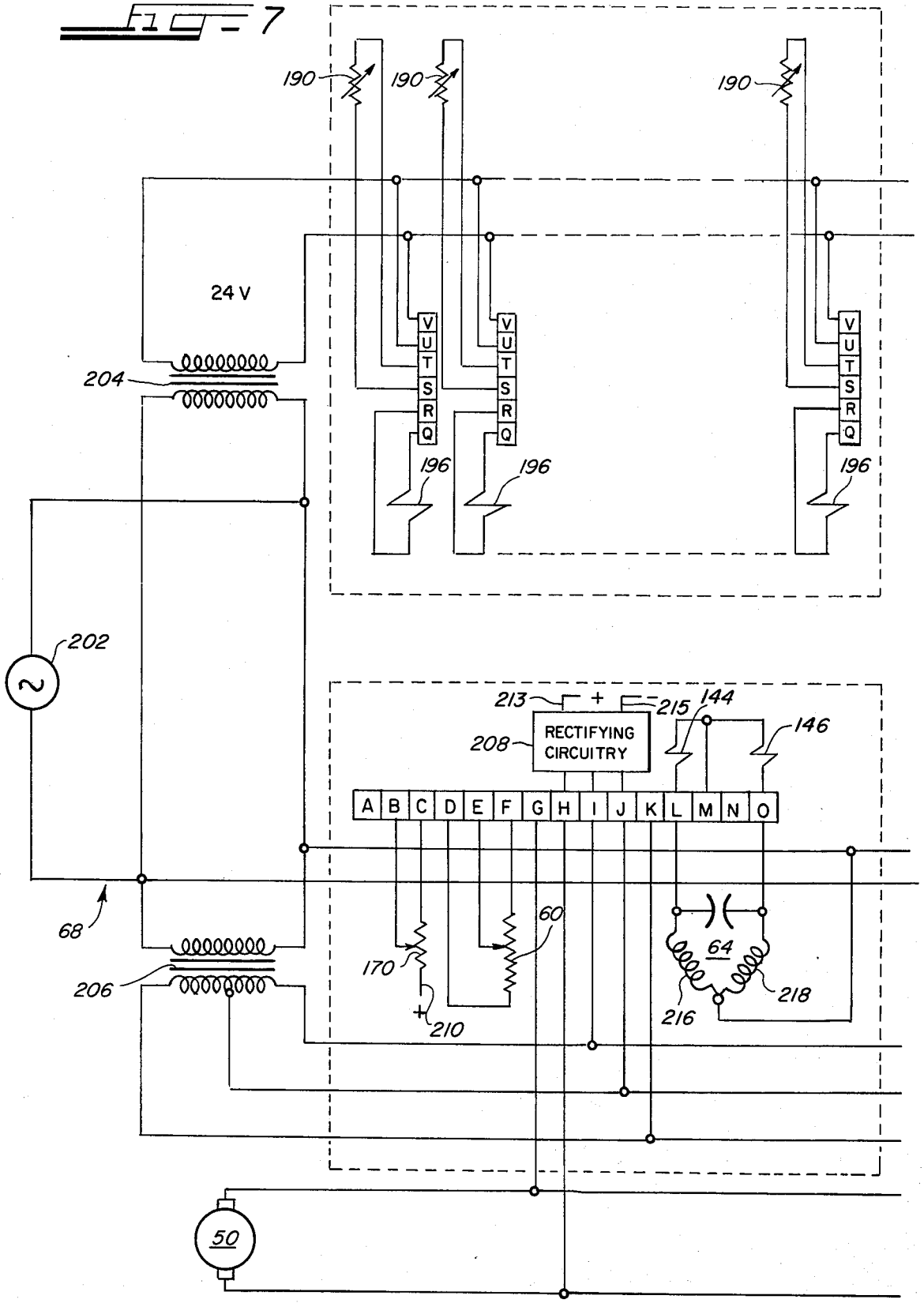
FIG. 7 is a schematic illustration of the power supply circuits for the system, showing the interrelationship between the control circuits of FIGS. 6A and 6B.

FIG. 7 schematically illustrates the power supply circuits for the system and the interrelationship of the circuits. Shown are portions of the valve control circuits illustrated in FIG. 6B, one each controlling a particular timed metering valve 28 of a fluid quantity control apparatus 24, and portions of the pressure adjustment circuits of FIG. 6A, one such circuit being necessary to control the pressure of the fluid presented to a fluid quantity control apparatus 24 having a plurality of the timed metering valves 28. As illustrated, terminals A through V correspond to terminals A through V of FIGS. 6A and 6B. Power is supplied to the apparatus by an alternating voltage source 202 of the power supply 68. This voltage is transformed to a lower alternating voltage value through a transformer 204 and presented to the terminals U and V of FIG. 6B. The voltage from the alternating voltage source 202 is also transformed by a transformer 206 and presented to terminals I, J and K. Conventional rectifying circuitry 208 is connected to the terminals I, J and K to rectify the voltage from the transformer 206 to desired positive and negative DC values. These positive and negative DC voltages are applied from positive terminal 213 and negative terminal 215 respectively to positive terminals 210 and negative terminals 212 (FIG. 6A).

As described above, the motor 64 is driven in two directions, one in which to open the compensator valve 48 and the other in which to close the compensator valve. If the forward relay 144 is activated, current is applied to the forward coil 216 of the motor 64 in order to open the compensator valve, while if the reverse relay 146 is activated, current is applied to the reverse coil 218 of the motor to close the compensator valve.

Figure 9:
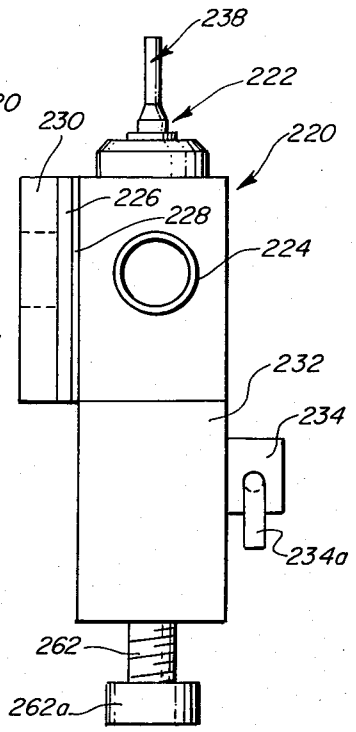
FIG. 9 is a side elevational view of the fluid manifold shown in FIG. 8.
Figure 8:
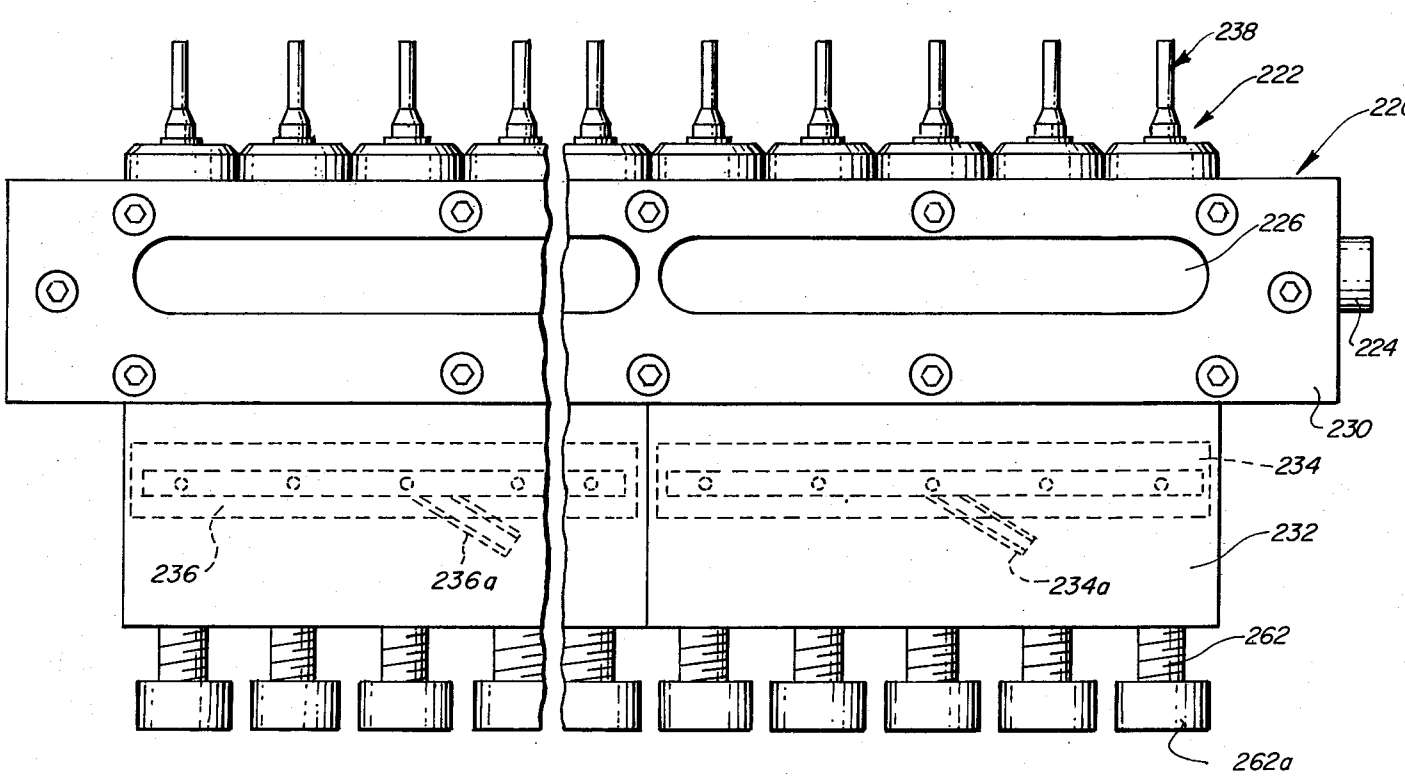
FIG. 8 is a front elevational view of a fluid manifold employing valve means of modified construction.
Figure 10:
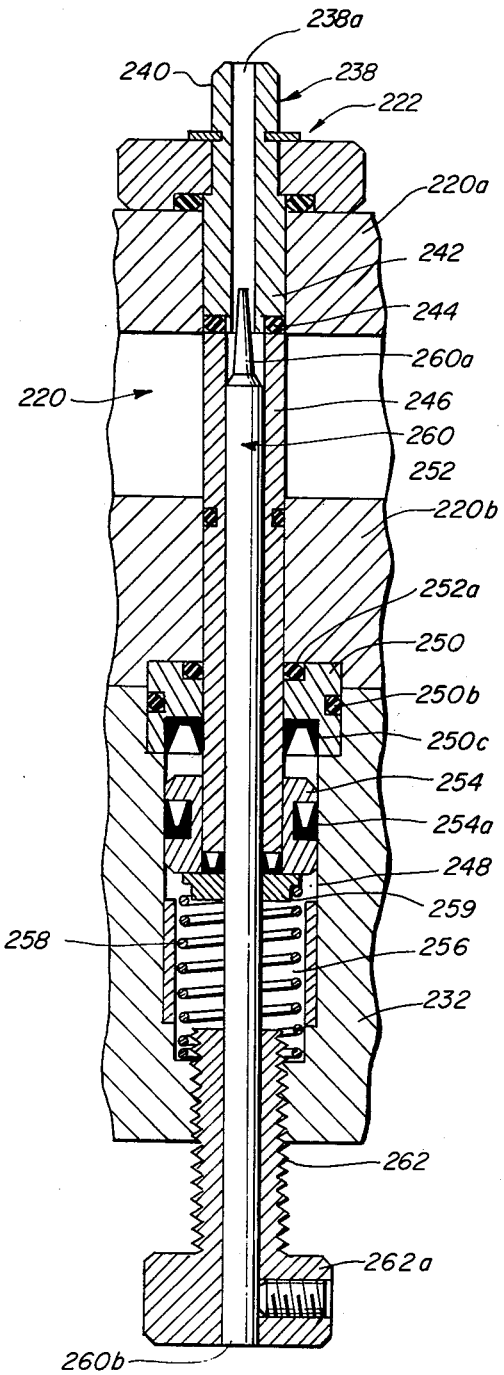
FIG. 10 is an enlarged cross sectional view of a single manually adjustable valve of the valve means shown in FIG. 8.

A second embodiment of the invention is illustrated in FIGS. 8 through 10. In this embodiment the valves do not fluctuate between open and closed positions but rather remain continuously open during spraying. The valves are adjustable so that the dampening fluid under a pressure which is adjusted in response to changes in the speed of the press is further controlled in its application to the spray nozzles by the individual valve adjustments.

In the embodiment of FIGS. 8 through 10 the pressure compensator 40 is utilized and this pressure compensator is adjustable in the manner described in connection with the embodiment of FIGS. 1 through 7. However, the solenoid operated timed metering valves 28 of the previous embodiment are eliminated as is the circuitry employed to control and varibly actuate these valves. Thus, the embodiment of FIGS. 8 through 10 employs less circuitry, thereby reducing the cost and improving the reliability of the system.

In FIGS. 8 and 9 there is shown a fluid manifold 220 employing a plurality of valves 222 of modified construction. The fluid manifold 220 is a hollow block having a connector 224 at one end for connecting with the outflow line 44 from the pressure reducing valve 48 (see FIG. 1). The fluid manifold is open at its front side and this front side opening is covered by a sight glass 226, a gasket 228 and a cover plate 230. Mounted below the fluid manifold 220 is an air cylinder housing 232 and mounted on the rear side of the air cylinder housing are several air manifolds 234 and 236. Although in FIG. 8 only two air manifolds are illustrated, it will be appreciated that there will normally be at least four air manifolds each for controlling a plurality of the valves 222 in the manner which will be hereinafter described. The air manifolds 234 and 236 are provided with air inlets 234a and 236a respectively, these air inlets being preferably controlled by suitable valving mechanisms such as an air toggle switch (not shown in this embodiment).

The preferred structure for each of the fluid valves 222 is illustrated in FIG. 10. The fluid tube connector 238 of the valve extends through the top wall 220a of the fluid manifold 220 and has a passageway 238*a* therethrough which communicates with the interior of the fluid manifold. The upper end 240 of the fluid tube connector is adapted to be connected to one of the conduits 22 (see FIG. 1) leading to the spray bar 12 and the lower end 242 of the fluid tube connector serves as a valve seat and carries a resilient O-ring 244.

This particular valve has two valve members which are movable toward and away from the lower end or valve seat portion 242 of the valve. The first of these valve members is a tubular valve closure sleeve 246 which is slidably mounted in the bottom wall 220*b* of the fluid manifold and extends into one of the air cylinders 248 of the air cylinder housing 232. The valve closure sleeve 246 also is slidably mounted within a bushing-like guide member 250 which not only serves as an additional guide for the sliding movement of the valve closure sleeve but also provides a seal between the bottom of the fluid manifold 220, the valve closure sleeve 246 and the air cylinder housing 232. This is accomplished with the aid of O-rings 250*a* and 250*b* and a seal ring 250*c*. An additional O-ring 252 is preferably employed to seal the sliding guide member within the opening in the bottom of the fluid manifold 220.

At the bottom end of the closure sleeve 246 there is carried an air piston 254 having a seal ring 254*a* with sealingly engages the interior walls of the air cylinder 248. The closure sleeve 246 and air piston 254 are thus mounted for vertical reciprocal movement between an upward or fully closed position as illustrated in FIG. 10, wherein the upper end of the closure member is in engagement with the O-ring 244, and a lower or open position, wherein the upper end of the closure member is withdrawn from engagement with the O-ring 244. In the closed or raised position of the closure sleeve fluid is prevented from passing from the fluid manifold 220 through the passageway 238*a* of the fluid tube connector. In the lowered or open position of the closure member, fluid is permitted to pass from the fluid manifold up through the passageway 238*a*.

A cylindrical sleeve-like stop member 256 limits the lower movement of the air piston 254 and the closure sleeve 246. A spring 258 in the bottom of the air cylinder 248 engages the bottom end piece 259 of the piston 254 to resiliently urge the piston and the closure sleeve 246 toward their raised or closed position. The upper portion interior of the air cylinder 248 is in communication with the air manifold 234 so that when the air manifold is pressurized the air pressure will act against the air piston 254 and cause it to move to its lowered or open position against the resistance of the spring 258. It will be noted from FIG. 8 that several of the valves 222 are connected to the same air manifold and thus when one of the manifolds is pressurized all of the valves controlled by that manifold will be moved to their open position.

In order to adjust the amount of fluid passing through the valve 222, it is preferred that there be an additional adjustment means. In the particular valve illustrated in FIG. 10, this is accomplished by means of a second valve member which is movable toward and away from the valve seat portion 242, this second valve member being in the form of a needle element 260 slidably mounted within the interior of the sleeve-like closure sleeve 246. The upper end 260*a* of the needle element 260 is reduced and tapered, and this element extends downwardly through the closure sleeve 246 and the air cylinder 248. Attached to the lower end of this element 260 is a threaded member 262 having a knurled knob-like end portion 262*a*. The member 262 is threaded into the bottom wall of the air cylinder housing 232.

The tapered upper end or tip 260*a* of the needle element 260 is adapted to extend partially into the valve seat portion 242 of the fluid tube connector and thus restricts the fluid passage through the passageway 238 of the valve 222. By adjusting the knob portion 262*a* of the threaded member 262 which is connected to the lower end of the needle element 260, the needle element may be moved toward and away from the valve seat portion 242 of the fluid tube connector and the degree of restriction of the fluid passage through the valve may thus be regulated.

While the foregoing is a preferred mode of adjustably restricting the passage of the dampening fluid through the fluid delivery means to the nozzles 14, it will be appreciated that many other types of adjustable restrictions may be devised within the spirit of the invention described herein.

Figure 11:
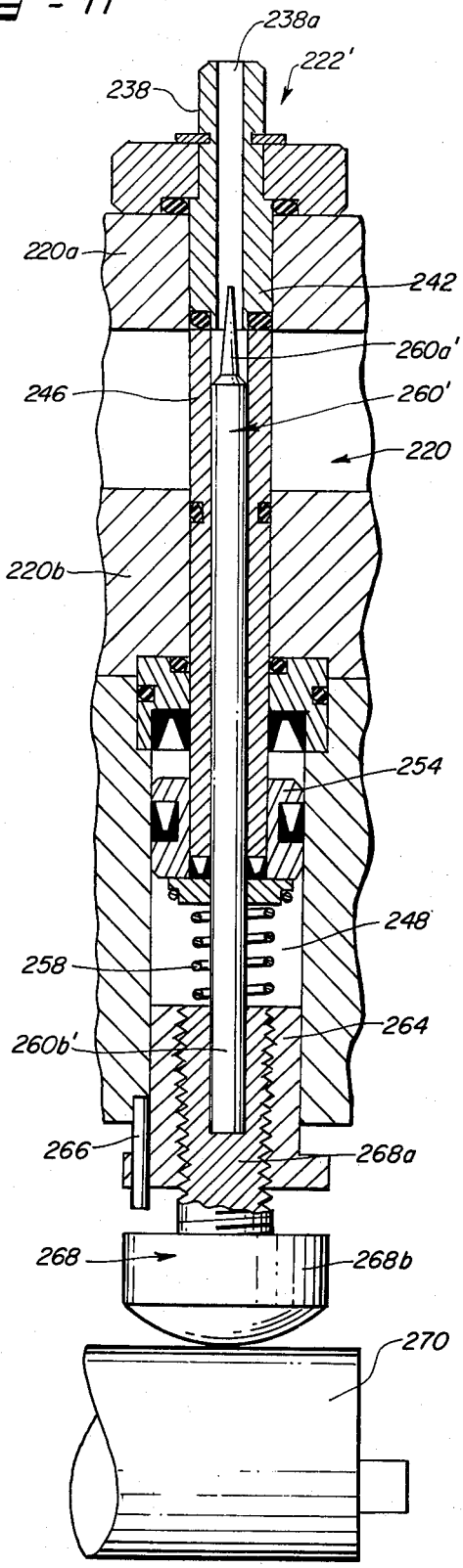
FIG. 11 is an enlarged cross sectional view of an automatically adjustable valve employed in a further modified system.
Figure 12:
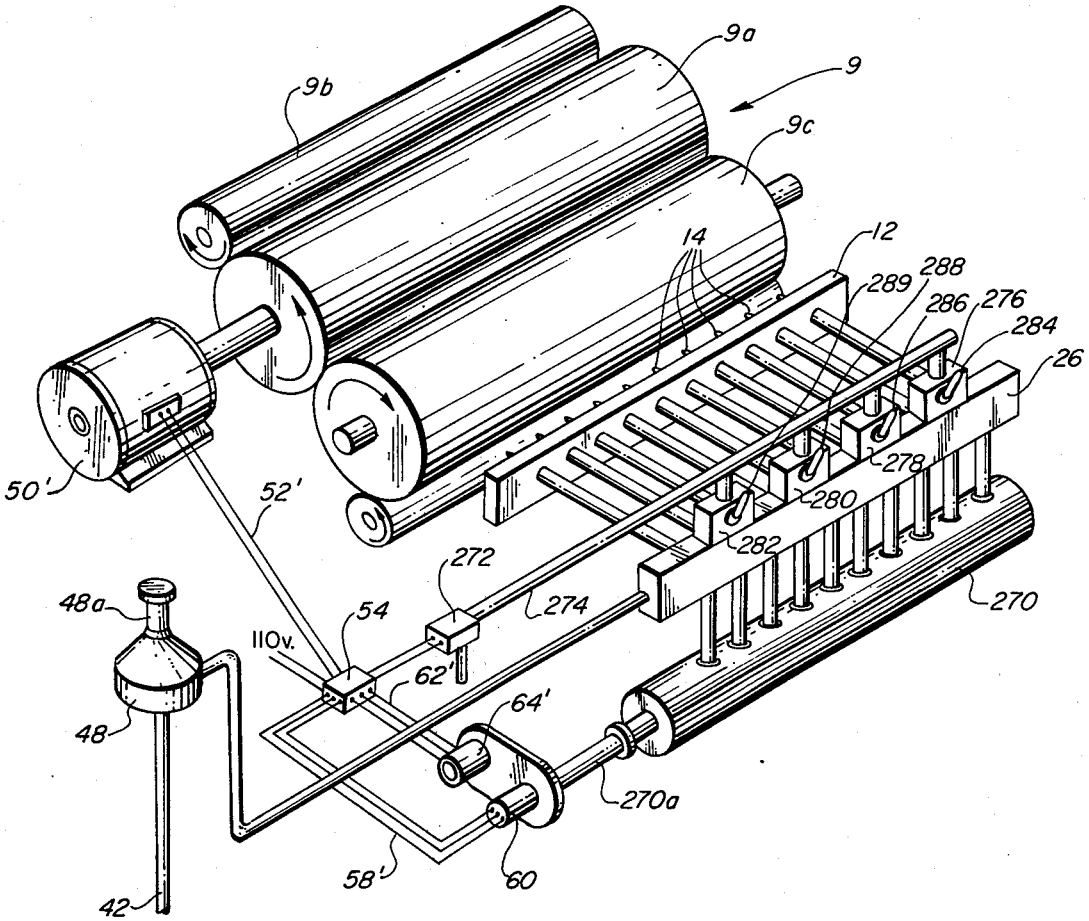
FIG. 12 is a perspective view of portions of the further modified spray dampening system utilizing the automatically adjustable valve of FIG. 11.

In FIGS. 11 and 12 (in which identical numbers are given to identical parts previously described and prime numbers are given to generally similar parts) there is shown a third embodiment of the invention wherein the pressure is kept constant and the valving of the fluid to the nozzles 14' is controlled in accordance with the speed of the press 9. For this purpose the valve may be altered. The modified valve shown in FIG. 11 is identical to the valve 222 just described in connection with the embodiment of FIG. 10, except for a modification in the connection for adjustment at the lower end 260*b'* of the needle element 260'. In this embodiment the lower end of the needle element is threaded into a slide member 264 which is mounted for sliding movement in the lower end of the air cylinder housing 232. The slide member 264 is prevented from rotating by means of a guide pin 266 affixed to and extending rearwardly from the lower end of the air cylinder housing 232. The slide member 264 has a slot or aperture to slidably accommodate the pin 266. A follower 268 has a shank portion 268*a* which is threaded into the lower end of the member 264 and a head portion 268*b* which is adapted to engage an eccentric cam roller 270. The slide member 264 and the follower 268 thus are effectively extensions of the needle element 260 and the length of this assembly is adjusted by threadedly adjusting the follower with respect to the slide members. This adjustment governs the degree of restriction of the fluid passage through the valve 222' when the valve is opened.

In operation the valve of FIG. 11 is open and closed precisely in the same manner as the valve of FIG. 10. However, the adjustment of the restriction is by means of the rotation of the eccentric cam roller 270. The follower 268 is adjusted relative to the slide member 264 to adjust the effective length of the needle element 260. If the effective length of the needle element 260' is effectively increased, the upper end 260*a'* of the needle element will move upwardly further into the lower end of the passageway 238*a* in the fluid tube connector 238 to increase the fluid restriction. If the needle element 260' is effectively shortened, the upper end of the element will move out of the passageway 238*a* to reduce the restriction and increase the flow of fluid from the fluid manifold 220 through the passageway 238 of the fluid tube connector.

The preferred means of accomplishing the rotational adjustment of the eccentric cam roller 270 is illustrated in FIG. 12. This adjustment mechanism is basically the same as the speed responsive control mechanism 49 previously described in the application. The tachometer generator 50' is operatively connected to the press and provides a voltage indication on wires 52' to a compensator adjustment control circuitry 54''' which accepts this first voltage value indicative of the speed of the press and also accepts a second voltage value indicative of the state of the adjustment of the eccentric cam roller 270.

This second voltage is determined by a multi turn potentiometer 60' which is coupled to the shaft **270*a* of the eccentric cam roller 270. The output voltage is presented to the control circuitry 54''' by suitable connections such as leads 58'. The voltages are compared in the compensator adjustment control circuitry 54''' in the manner previously described in connection with the compensator adjustment control circuitry 54–54''' of the first embodiment, and a signal indicative of this comparison is transmitted along lines 62' to the reversable motor 64'. The motor 64' in response to the signal along the lines 62' rotates the shaft 270*a* of the eccentric cam roller in a direction which will control the position of the needle elements 260' within the valve 222'**.

The valve 222 of the previous or second embodiment and the valve 222' of the third embodiment are opened and closed by air pressure applied to the air manifolds. In FIG. 12 a voltage-responsive air switch 272 controls the air line 274 and the application of air to the air manifolds 276, 278, 280 and 282. As discussed in connection with the second embodiment, air toggle switches may be used to further control the application of air pressure to the valves 222 and 222'. In FIG. 12 four such air toggle switches 284, 286, 288 and 289 are illustrated, each controlling one of the air manifolds which in turn controls the opening and closing of several valves. It is preferred that each manifold control approximately 5 valves which will cover one newspaper page, and with four manifolds each controlled by an air toggle switch four pages may be controlled. Of course, the number of spray nozzles 14 and valves 222' and thus the number of valves controlled by each manifold may vary from application to application.

The air switch 272 is preferably connected to the compensator adjustment control circuitry 54''' and operates to open the air line 274 when the speed of the press comes up to a certain level and to shut off the air line 274 when the speed of the press falls below that predetermined value. When the air line 274 is opened as determined by the air switch 272 air pressure is applied through the air toggle switches to open the valves 222 and permit the dampening fluid to flow to the nozzles 14.

The foregoing description of the apparatus and circuitry has been given as an example of the presently preferred embodiments. It will be appreciated that much of the circuitry could be changed by incorporating additional solid state components and that modifications of the structures of the valves, nozzles and the like may readily occur to persons skilled in the art. Various other changes and modifications can be made to the invention without departing from the true spirit thereof or the scope of the following claims.

I claim:

1. In a spray dampening system for delivering a dampening fluid to a rotating cylinder of a printing press; a plurality of spray nozzles; means supplying air under pressure to said nozzles to atomize and transport the dampening fluid to the printing press cylinder; fluid delivery means for delivering dampening fluid to said nozzles, said fluid delivery means including first fluid regulating means for adjustably restricting the passage of dampening fluid through said fluid delivery means to said nozzles, second fluid regulating means for adjustably regulating the pressure of the fluid delivered to said nozzles by said fluid delivery means; and regulator control means, comprising first sensing means for sensing the speed of the press, second sensing means for sensing the state of one of said fluid regulating means, and means operatively connected to said one fluid regulating means and responsive to said first and second sensing means for adjusting said one fluid regulating means in accordance with the speed of the press, whereby the flow of fluid to the nozzles may be adjustably regulated.

2. The apparatus according to claim 1 wherein said first fluid regulating means includes a plurality of valves each associated with at least one of said nozzles.

3. The apparatus according to claim 2 wherein the valves are adjustable and continuously open during spraying.

4. The apparatus according to claim 2 and further including means responsive to the speed of the press for opening said valves when the press has reached a predetermined speed.

5. The apparatus according to claim 1 wherein said regulator control means is operatively connected to said first adjustable regulating means for adjustably restricting the passage of dampening fluid through said delivery means to said nozzles in accordance with the speed of the press.

6. The apparatus according to claim 1 and wherein said control means is operatively connected to said second adjustable regulating means for adjustably regulating the pressure of the fluid delivered to said nozzles in accordance with the speed of the press.

7. The apparatus according to claim 1 wherein said first fluid regulating means includes a plurality of valves, each valve having a valve restriction element for restricting the fluid passage through said valve and selectively movable within each valve to adjust the degree of restriction of the fluid passage through said valve, a multiple element adjustment member associated with said valve restriction elements mounted for movement to effect simultaneous positioning movement of said elements, and said regulator control means is operatively connected to the multiple element adjustment member of said first fluid regulating means, whereby the opening of said valves may be simultaneously and selectively limited in response to the speed of the press.

8. The apparatus according to claim 2 wherein said first fluid regulating means further includes individual adjustment means for adjusting each of said valve restriction elements relative to said multiple element adjustment member.

9. The apparatus according to claim 7 wherein said second sensing means senses the position of said multiple element adjustment member and said means responsive to said first and second sensing means adjusts the position of said multiple element adjustment member to increase the opening of said valves when the speed of the press increases and to decrease the opening of said valves when the speed of the press decreases.

10. The apparatus according to claim 9 wherein said multiple element adjustment member is an eccentrically mounted roller mounted for rotation in engagement with the movable limit elements of said valves to forcibly move said elements from one position of adjustment to another.

11. In a spray dampening system for delivering a dampening fluid to a rotating cylinder of a printing press, a plurality of spray nozzles; means supplying air under pressure to said nozzles to atomize and transport the dampening fluid to the printing press cylinder;

fluid delivery means for delivering dampening fluid under pressure to said nozzles;

said fluid delivery means including valve means for adjustably restricting the passage of dampening fluid through said fluid delivery means to said nozzles, and said fluid delivery means further including pressure compensator means for adjustably regulating the pressure of the dampening fluid supplied to said valve means, said pressure compensator means comprising an adjustable pressure regulating valve having an adjustable control element, first sensing means for sensing the speed of the press, second sensing means for sensing the state of pressure adjustment of said pressure regulating valve, and compensator control means responsive to said first and second sensing means for adjusting the adjustable control element of said pressure regulating valve to increase the outflow pressure from said valve when the speed of the press increases and to decrease the outflow pressure when the speed of the press decreases.

12. The apparatus according to claim 11 wherein said first sensing means for sensing the speed of the press is a tachometer generator operatively connected to the press whereby the voltage output from said generator will be indicative of the speed of the press.

13. The apparatus according to claim 11 wherein said second sensing means is operatively connected to the adjustable control element of said pressure regulating valve for sensing the position of adjustment of said element.

14. The apparatus according to claim 13 wherein said second sensing means includes a potentiometer having an adjustable control element operatively coupled to the adjustable control element of said pressure regulating valve, whereby the voltage applied to the potentiometer will be regulated according to the position of adjustment of the coupled control elements.

15. The apparatus according to claim 11 wherein said compensator control means includes a reversible motor operatively coupled to the adjustable control element of said pressure regulating valve.

16. The apparatus according to claim 15 wherein said first sensing means is adapted to present a first voltage to said compensator control means indicative of the speed of the press, said second sensing means is adapted to present a second voltage to said compensator control means indicative of the state of pressure adjustment of said pressure regulating valve, and said compensator control means further includes a voltage comparator circuit for comparing the voltages presented by said first and second sensing means and for energizing said reversible motor for operation alternatively in one direction if there is a relative overbalance of voltage from said first sensing means and in the opposite direction if there is a relative overbalance of voltage from said second sensing means.

* * * * *